US009449435B2

(12) United States Patent
Kalinadhabhotla et al.

(10) Patent No.: US 9,449,435 B2
(45) Date of Patent: Sep. 20, 2016

(54) ACCELEROMETER AND VOLTAGE BASED KEY-ON AND KEY-OFF DETECTION

(71) Applicant: HTI IP, LLC, Atlanta, GA (US)

(72) Inventors: Dedeepya Kalinadhabhotla, Atlanta, GA (US); Sneha Akula, Atlanta, GA (US); Benjamin J. Hamby, Atlanta, GA (US); Alex D. Berkobin, Canton, GA (US)

(73) Assignee: Verizon Telematics Inc., Atlanta, GA (US)

( * ) Notice: Subject to any disclaimer, the term of this patent is extended or adjusted under 35 U.S.C. 154(b) by 164 days.

(21) Appl. No.: 14/061,391

(22) Filed: Oct. 23, 2013

(65) Prior Publication Data

US 2015/0112539 A1 Apr. 23, 2015

(51) Int. Cl.
*G07C 5/08* (2006.01)
*G07C 5/00* (2006.01)

(52) U.S. Cl.
CPC ..... *G07C 5/008* (2013.01); *G07C 5/0808* (2013.01)

(58) Field of Classification Search
USPC ..... 701/29.1
See application file for complete search history.

(56) References Cited

U.S. PATENT DOCUMENTS 4,243,005 A * 1/1981 Hisatomi ..... 123/638
5,787,377 A * 7/1998 Watanabe et al. ..... 701/45
6,125,313 A * 9/2000 Watanabe et al. ..... 701/45
6,462,649 B1 * 10/2002 Kimura ..... 340/435
6,485,081 B1 * 11/2002 Bingle et al. ..... 296/76
7,421,321 B2 * 9/2008 Breed et al. ..... 701/33.6
2002/0196131 A1 * 12/2002 McCarthy et al. ..... 340/425.5
2003/0102688 A1 * 6/2003 Bingle et al. ..... 296/76
2003/0117274 A1 * 6/2003 Kuragaki et al. ..... 340/436
2005/0023858 A1 * 2/2005 Bingle et al. ..... 296/76
2005/0273218 A1 * 12/2005 Breed et al. ..... 701/2
2006/0025897 A1 * 2/2006 Shostak et al. ..... 701/1
2006/0180371 A1 * 8/2006 Breed et al. ..... 180/197
2006/0290518 A1 * 12/2006 Bingle et al. ..... 340/573.1
2007/0282518 A1 * 12/2007 Labitzke et al. ..... 701/115
2011/0106373 A1 * 5/2011 Hergesheimer et al. ..... 701/33
2011/0112717 A1 * 5/2011 Resner ..... 701/33
2013/0275001 A1 * 10/2013 Hergesheimer et al. ..... 701/36

* cited by examiner

*Primary Examiner* — Shelley Chen

(57) ABSTRACT

A device may receive a first type of measurement associated with a vehicle and receive a second type of measurement associated with a power source connected to the vehicle. The second type of measurement may be different than the first type of measurement. The device may determine a key-on or a key-off status of the vehicle based on the first type of measurement and the second type of measurement without communicating with a vehicle diagnostic system associated with the vehicle. The key-off status may correspond to an engine of the vehicle being powered off and the key-on status may correspond to the engine of the vehicle being powered on. The device may initiate communications with the vehicle diagnostic system based on determining the key-on status.

18 Claims, 8 Drawing Sheets

400

Accelerometer Measurements
410

| Time Index (seconds) | Reading (mG) |
|---|---|
| 0 | 66 |
| 1 | 60 |
| 2 | 48 |
| 3 | 72 |
| 4 | 54 |
| 5 | 42 |
| 6 | 54 |
| 7 | 102 |
| 8 | 96 |
| 9 | 108 |
| 10 | 90 |
| 11 | 96 |
| 12 | 84 |
| 13 | 78 |
| 14 | 102 |
| ⋮ | |
| T | Accelerometer reading at time T |

| Standard Deviation (mG) | |
|---|---|
| Std Dev 1 (0-5 sec) | 11.22 |
| Std Dev 2 (1-6 sec) | 10.33 |
| Std Dev 3 (2-7 sec) | 22.02 |
| Std Dev 4 (3-8 sec) | 24.49 |
| Std Dev 5 (4-9 sec) | 29.07 |
| Std Dev 6 (5-10 sec) | 27.28 |
| Std Dev 7 (6-11 sec) | 19.13 |
| Std Dev 8 (7-12 sec) | 8.49 |
| Std Dev 9 (8-13 sec) | 10.51 |
| Std Dev 10 (9-14 sec) | 11.22 |
| ⋮ | |
| Std Dev X | X |

| Average Standard Deviations (mG) | |
|---|---|
| Avg 1 (Std Dev 1 to Std Dev 5) | 19.43 |
| Avg 2 (Std Dev 2 to Std Dev 6) | 22.64 |
| Avg 4 (Std Dev 3 to Std Dev 7) | 24.40 |
| Avg 4 (Std Dev 4 to Std Dev 8) | 21.69 |
| Avg 5 (Std Dev 5 to Std Dev 9) | 18.89 |
| Avg 6 (Std Dev 6 to Std Dev 10) | 15.32 |
| ⋮ | |
| Avg Z | Z |

Fig. 4A

400

Voltage Measurements

420

| Time Index (seconds) | Reading (V) |
|---|---|
| 0 | 12.3 |
| 1 | 13.2 |
| 2 | 13.4 |
| 3 | 13.2 |
| 4 | 13.1 |
| 5 | 12.9 |
| 6 | 12.8 |
| 7 | 13.2 |
| 8 | 13.4 |
| 9 | 13.5 |
| 10 | 13.6 |
| 11 | 13.7 |
| 12 | 13.4 |
| 13 | 13.9 |
| 14 | 14.1 |
| ••• | |
| T | Voltage reading at time T |

| Running Average (V) | |
|---|---|
| Average 1 (0-5 sec) | 13.02 |
| Average 2 (1-6 sec) | 13.10 |
| Average 3 (2-7 sec) | 13.10 |
| Average 4 (3-8 sec) | 13.10 |
| Average 5 (4-9 sec) | 13.15 |
| Average 6 (5-10 sec) | 13.23 |
| Average 7 (6-11 sec) | 13.37 |
| Average 8 (7-12 sec) | 13.47 |
| Average 9 (8-13 sec) | 13.58 |
| Average 10 (9-14 sec) | 13.70 |
| ••• | |
| Average N | N |

Fig. 4B

ACCELEROMETER AND VOLTAGE BASED KEY-ON AND KEY-OFF DETECTION

BACKGROUND

A vehicle (e.g., an automobile) may include a vehicle diagnostic system (e.g., an on-board diagnostic (OBD) system or an OBD II system). A data collection device can connect to the vehicle diagnostic system (e.g., via a serial connection port, such as an OBD port, an OBD II port, or the like) to collect vehicle data and provide the vehicle data to a client server (e.g., to process the vehicle data to track vehicle maintenance, perform vehicle troubleshooting, determine auto insurance rates based on driving habits, etc.). Communications between the data collection device and the diagnostic systems, while the vehicle is powered off, can cause operational interferences (e.g., interference that may prevent the vehicle from starting, cause the vehicle's battery to drain, and/or cause the vehicle's indicators/dash lights and/or other systems to behave erratically).

BRIEF DESCRIPTION OF THE DRAWINGS

FIGS. 4A-4B illustrate an example data structure that may be stored by one or more devices in the environment of FIG. 2;

DETAILED DESCRIPTION OF THE PREFERRED EMBODIMENTS

The following detailed description refers to the accompanying drawings. The same reference numbers in different drawings may identify the same or similar elements.

Systems and/or methods, as described herein, may determine a status of a vehicle without communicating with a vehicle diagnostic system (e.g., an on-board diagnostic (OBD) system, an OBD II system, or the like). For example, the systems and/or methods may determine a key-on status (e.g., when an engine of the vehicle is powered on), and a key-off status (e.g., when the engine of the vehicle is powered off). As a result, communications between a data collection device and the vehicle diagnostic system may be avoided when the vehicle is in the key-off state, thereby preventing the vehicle's power source (e.g., a battery) from draining (e.g., when a battery recharger, such as an alternator, is not in operation) and preventing operational interferences (e.g., interferences that may prevent the vehicle from starting, and/or cause the vehicle's indicators/dash lights and/or other systems to behave erratically).

Based on determining that the vehicle is in a key-on state, the data collection device may communicate with the vehicle diagnostic system (e.g., via a serial connection port, such as an OBD port, an OBD II port, or the like) to receive vehicle data and provide the vehicle data to a client server. In some implementations, the vehicle data may be used for vehicle maintenance, troubleshooting, determining driving habits, auto insurance rating purposes, etc.

While systems and/or methods, as described herein, may determine accelerometer and/or voltage measurements to determine whether the vehicle is in a key-on or key-off state, the systems and/or methods are not so limited. For example, the systems and/or methods may determine whether the vehicle is in a key-on or key-off state based on some other vehicle information, such as electrical signals from switches (e.g., door ajar switches, alternator switches, etc.), that may indicate whether the vehicle is in a key-on or key-off state.

Figure 1:
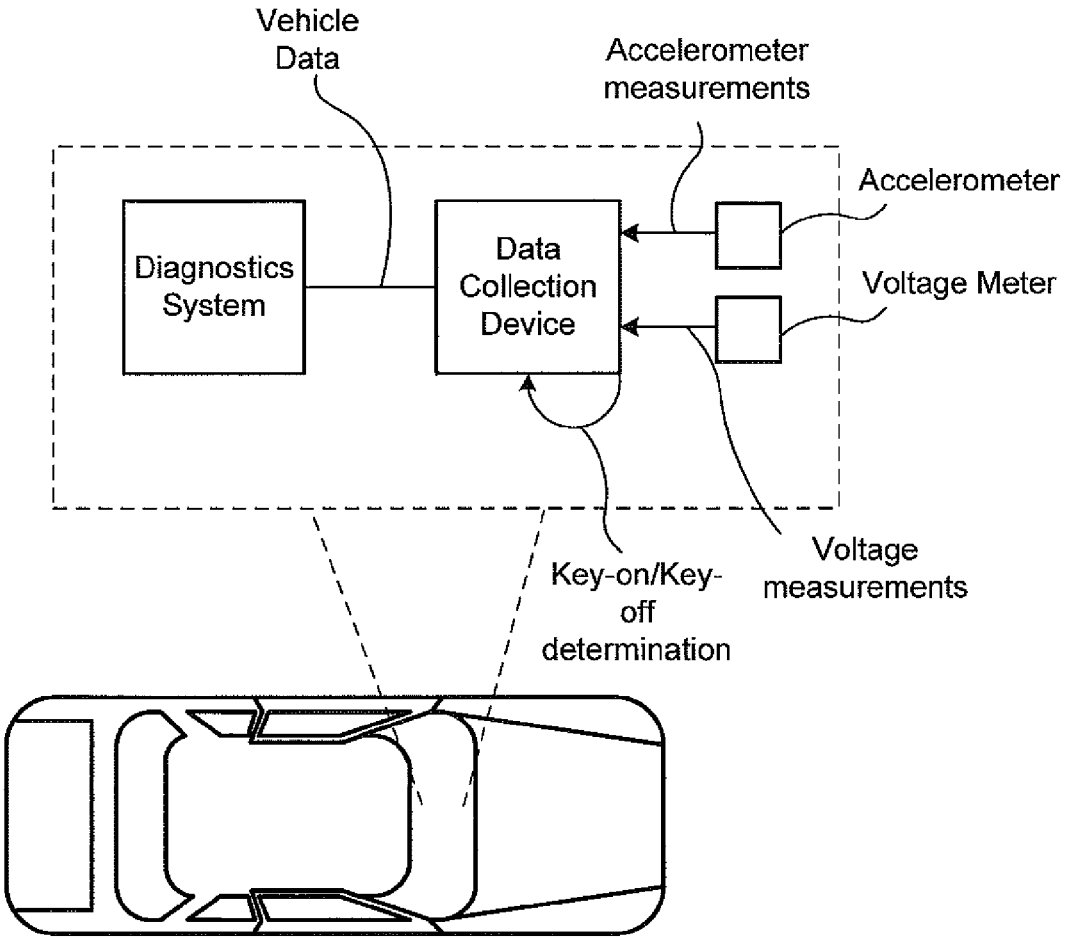
FIG. 1 illustrates an example overview of an implementation described herein.

FIG. 1 illustrates an example overview of an implementation described herein. As shown in FIG. 1, a data collection device and a vehicle diagnostics system (referred to hereinafter as a "diagnostics system") may be implemented within a vehicle. In some implementations, the data collection device may connect with the diagnostics system via a serial connection port (e.g., an OBD port, and OBD II port, or the like). In some implementations, the data collection device may receive accelerometer measurements, associated with the vehicle, and voltage measurements, associated with a battery of vehicle. For example, the data collection device may include an accelerometer and a voltage meter connected to the battery to receive the accelerometer and voltage measurements.

Based on the accelerometer measurements and/or the voltage measurements, the data collection device may determine whether the vehicle is in a key-on or key-off state. For example, when an average standard deviation of the accelerometer measurements and/or an average of the voltage measurements exceed particular thresholds, the data collection device may determine that the vehicle is in motion, and that a battery charger of the battery (e.g., an alternator, or the like), is in operation, thereby indicating that the vehicle is in a key-on state. In some implementations, when the average standard deviation of the accelerometer measurements and/or the average voltage measurements are below particular thresholds for a particular amount of time, the data collection device may determine that the vehicle is not in motion, and that the battery charger is not in operation, thereby indicating that the vehicle is in a key-off state. As a result, the data collection device may determine a key-on or key-off state without communicating with the diagnostics system, thereby preventing the data collection device from communicating with the diagnostic system via a key-on channel (e.g., a channel that is to be used when the vehicle is in the key-on state) when the vehicle is in the key-off state, and thus preventing the vehicle's systems from behaving erratically.

In some implementations, the data collection device may communicate with the diagnostics system to receive vehicle data (e.g., information identifying the vehicle's velocity, engine speed, throttle, gasoline consumption, etc.) based on determining that the vehicle is in a key-on state. In some implementations, the data collection device may identify when a vehicle trip starts and ends (e.g., corresponding to when the vehicle is in the key-on and key-off states), and may collect trip related data (e.g., vehicle data that is gathered during a period between when the vehicle is in the key-on and key-off states). In some implementations, the data collection device may provide the trip related data to a client server.

Figure 2:
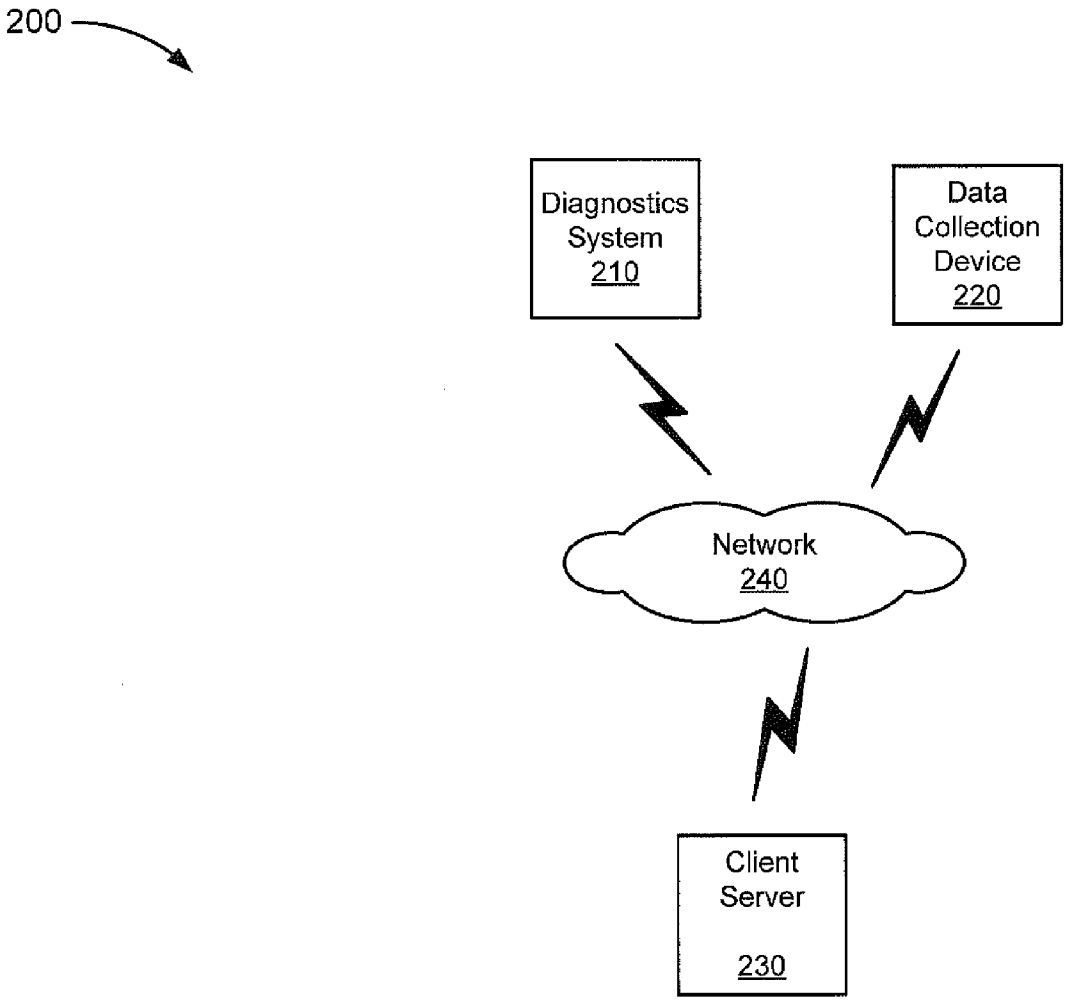
FIG. 2 illustrates an example environment in which systems and/or methods, described herein, may be implemented.

FIG. 2 is a diagram of an example environment 200 in which systems and/or methods described herein may be implemented. As shown in FIG. 2, environment 200 may include diagnostics system 210, data collection device 220, client server 230, and network 240.

Diagnostics system 210 may include a vehicle diagnostics system, such as an OBD system, an OBD II system, or the like. In some implementations, diagnostics system 210 may be implemented within a vehicle and may log vehicle data, such as information identifying the vehicle's velocity, engine speed, throttle, gasoline consumption, etc. In some implementations, diagnostics system 210 may communicate with data collection device 220 to provide the vehicle data to data collection device 220.

Data collection device 220 may receive vehicle data from diagnostics system 210, and may provide the vehicle data to client server 230. In some implementations, data collection device 220 may include one or more accelerometer devices and/or voltage meters to gather accelerometer measurements, associated with a vehicle, and voltage measurements associated with a battery of the vehicle (e.g., to determine whether the vehicle is in a key-on or key-off state). For example, data collection device 220 may include a passive-mode accelerometer and an active-mode accelerometer. As described in greater detail below with respect to FIG. 5, data collection device 220 may gather accelerometer measurements (e.g., via the active-mode accelerometer) and/or voltage measurements based on detecting an initial acceleration of the vehicle, such as an initial movement or vibration of the vehicle (e.g., via the passive-mode accelerometer, when the initial acceleration causes a circuit or switch to trip, or detecting the initial acceleration using some other technique). Additionally, or alternatively, data collection device 220 may gather accelerometer measurements and/or voltage measurements when data collection device 220 is initially connected (e.g., plugged in) to diagnostics system 210. For example, the detection of initial vehicle acceleration and/or the initial connection to diagnostics system 210 may indicate that the vehicle has transitioned from a key-off state to a key-on state.

In some implementations, data collection device 220 may determine whether the vehicle is in a key-on or key-off state based on the accelerometer and/or voltage measurements that may be gathered after detecting the initial vehicle acceleration or connection to diagnostics system 210. In some implementations, data collection device 220 may communicate with diagnostics system 210 over particular communication channels based on whether the vehicle is in the key-on or key-off state. For example, data collection device 220 may communicate via a key-on channel to gather particular vehicle data when the vehicle is in the key-on state, and may communicate via a key-off channel to gather particular data when the vehicle is in the key-off state. In some implementations, data collection device 220 may prevent key-on communications (e.g., communications over the key-on channel) when the vehicle is in a key-off state (e.g., to prevent operational interferences associated with the vehicle).

Client server 230 may include a computing device, such as a server device, a desktop computing device, or the like. In some implementations, client server 230 may receive vehicle data from data collection device 220. In some implementations, client server 230 may store the vehicle data and may process the vehicle data to form processed data that can be used for vehicle maintenance, troubleshooting, auto insurance rating purposes, etc.

Network 240 may include one or more wired and/or wireless networks. For example, network 240 may include a serial bus connection, a Bluetooth network, a cellular network (e.g., a second generation (2G) network, a third generation (3G) network, a fourth generation (4G) network, a fifth generation (5G) network, a long-term evolution (LTE) network, a global system for mobile (GSM) network, a code division multiple access (CDMA) network, an evolution-data optimized (EVDO) network, or the like), a public land mobile network (PLMN), and/or another network. Additionally, or alternatively, network 240 may include a local area network (LAN), a wide area network (WAN), a metropolitan network (MAN), a telephone network (e.g., the Public Switched Telephone Network (PSTN)), an ad hoc network, a managed IP network, a virtual private network (VPN), an intranet, the Internet, a fiber optic-based network, and/or a combination of these or other types of networks.

The quantity of devices and/or networks, illustrated in FIG. 2, is not limited to what is shown. In practice, there may be additional devices and/or networks; fewer devices and/or networks; different devices and/or networks; or differently arranged devices and/or networks than illustrated in FIG. 2. Also, in some implementations, one or more of the devices of environment 200 may perform one or more functions described as being performed by another one or more of the devices of environment 200. Devices of environment 200 may interconnect via wired connections, wireless connections, or a combination of wired and wireless connections.

Figure 3:
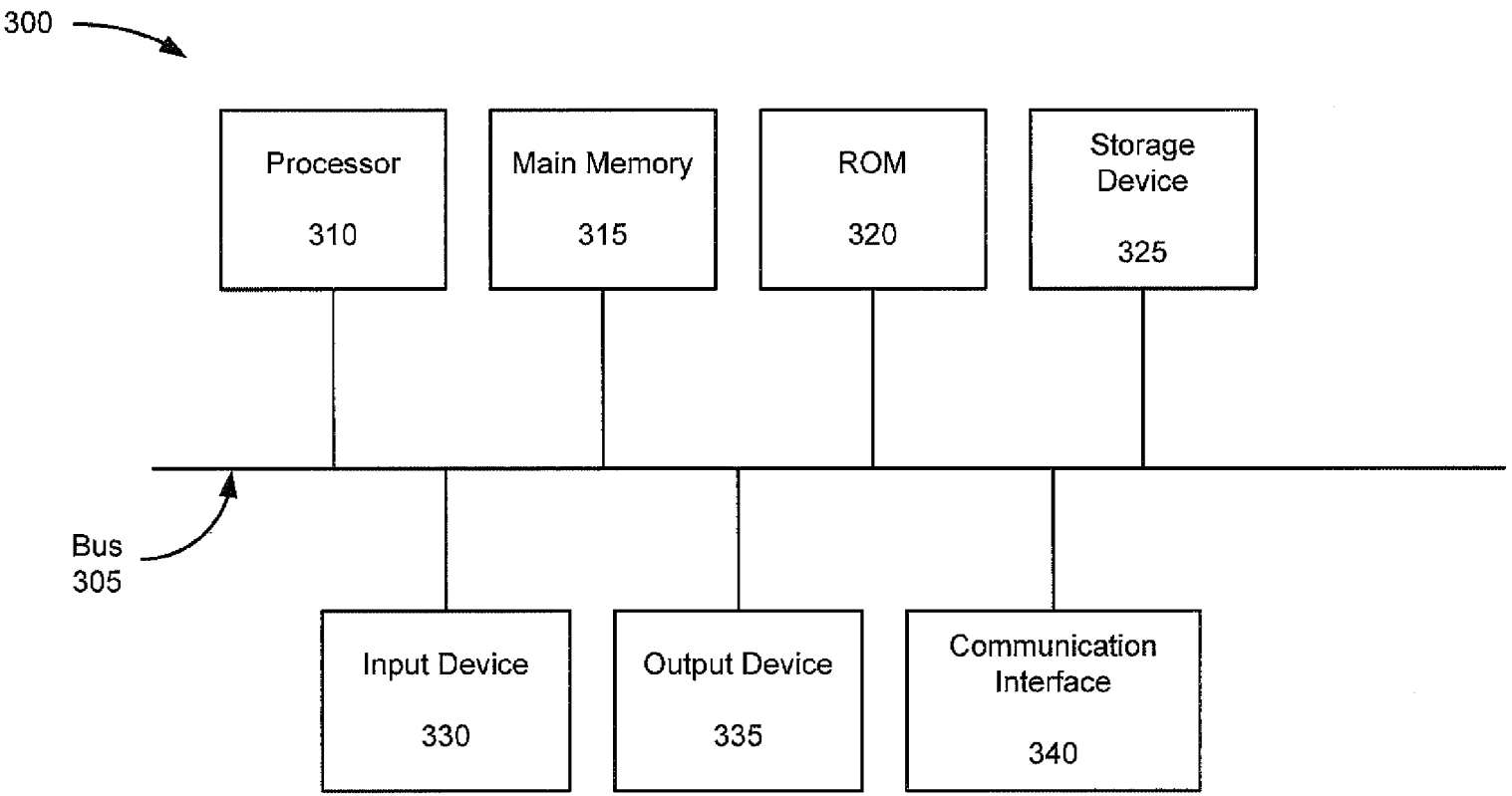
FIG. 3 illustrates example components of a device that may be used within the environment of FIG. 2.

FIG. 3 illustrates example components of a device 300 that may be used within environment 200 of FIG. 2. Device 300 may correspond to diagnostics system 210, data collection device 220, and/or client server 230. Each of diagnostics system 210, data collection device 220, and/or client server 230 may include one or more devices 300 and/or one or more components of device 300.

As shown in FIG. 3, device 300 may include a bus 305, a processor 310, a main memory 315, a read only memory (ROM) 320, a storage device 325, an input device 330, an output device 335, and a communication interface 340.

Bus 305 may include a path that permits communication among the components of device 300. Processor 310 may include a processor, a microprocessor, an application specific integrated circuit (ASIC), a field programmable gate array (FPGA), or another type of processor that interprets and executes instructions. Main memory 315 may include a random access memory (RAM) or another type of dynamic storage device that stores information or instructions for execution by processor 310. ROM 320 may include a ROM device or another type of static storage device that stores static information or instructions for use by processor 310. Storage device 325 may include a magnetic storage medium, such as a hard disk drive, or a removable memory, such as a flash memory.

Input device 330 may include a component that permits an operator to input information to device 300, such as a control button, a keyboard, a keypad, or another type of input device. Output device 335 may include a component that outputs information to the operator, such as a light emitting diode (LED), a display, or another type of output device. Communication interface 340 may include any transceiver-like component that enables device 300 to communicate with other devices or networks. In some implementations, communication interface 340 may include a wireless interface, a wired interface, or a combination of a wireless interface and a wired interface.

Device 300 may perform certain operations, as described in detail below. Device 300 may perform these operations in response to processor 310 executing software instructions contained in a computer-readable medium, such as main memory 315. A computer-readable medium may be defined as a non-transitory memory device. A memory device may include memory space within a single physical storage device or memory space spread across multiple physical storage devices.

The software instructions may be read into main memory 315 from another computer-readable medium, such as storage device 325, or from another device via communication interface 340. The software instructions contained in main memory 315 may direct processor 310 to perform processes that will be described later. Alternatively, hardwired circuitry may be used in place of or in combination with software instructions to implement processes described herein. Thus, implementations described herein are not limited to any specific combination of hardware circuitry and software.

In some implementations, device 300 may include additional components, fewer components, different components, or differently arranged components than are shown in FIG. 3.

FIGS. 4A-4B illustrate an example data structure 400 that may be stored by one or more devices in environment 200, such as data collection device 220. In some implementations, data structure 400 may be stored in a memory of data collection device 220. In some implementations, data structure 400 may be stored in a memory separate from, but accessible by, data collection device 220. In some implementations, data structure 400 may be stored by some other device in environment 200, such as diagnostics system 210 and/or client server 230. A particular instance of data structure 400 may contain different information and/or fields than another instance of data structure 400.

Information stored by data structure 400 may include accelerometer and voltage measurements, gathered by data collection device 220, when initial vehicle acceleration is detected (e.g., indicating that the vehicle may have transitioned from a key-off state to a key-on state). In some implementations, information stored by data structure 400 may be used to determine a key-on or a key-off status of the vehicle.

As shown in FIGS. 4A-4B, data structure 400 may include accelerometer measurements field 410 and voltage measurements field 420.

Accelerometer measurements field 410 may store measurements gathered by an accelerometer of data collection device 220 (e.g., an active-mode accelerometer). For example, accelerometer measurements field 410 may store information identifying a time index and a corresponding accelerometer reading at the time index (e.g., a measurement of acceleration in units of gravitational acceleration (G), where G=9.80665 m/s$^2$). As an example, assume that at time index=0 seconds, the accelerometer of data collection device 220 measured an accelerometer reading of 66 milli-G (mG). Given this assumption, accelerometer measurements field 410 may store a reading of 66 mG at time index=0 seconds. In a similar manner, accelerometer measurements field 410 may store accelerometer readings for T time indexes (where T≥0).

In some implementations, the accelerometer reading may correspond to an average reading of samples within a particular time period. For example, the accelerometer of data collection device 220 may gather accelerometer readings at a rate of 60 hertz (60 Hz), or 60 readings per second.

As shown in FIG. 4A, accelerometer measurements field 410 may store information identifying standard deviations of accelerometer readings during different time periods (e.g., rolling five-second time periods, or some other time period). For example, accelerometer measurements field 410 may store a first standard deviation for accelerometer readings during a first time period (e.g., a time period including time index=0 seconds to time index=5 seconds). In an example shown in FIG. 4A, accelerometer measurements field 410 may store a first standard deviation (e.g., Std Dev 1) of 11.22 mG corresponding to the standard deviation of the accelerometer readings of 66 mG, 60 mG, 48 mG, 72 mG, 54 mG, and 42 mG at time indexes 0 seconds, 1 second, 2 seconds, 3 seconds, 4 seconds, and 5 seconds, respectively. Further, accelerometer measurements field 410 may store a second standard deviation (e.g., Std Dev 2), of 10.33 mG corresponding to the standard deviation of accelerometer readings of 60 mG, 48 mG, 72 mG, 54 mG, 42 mG, and 54 mG at time indexes 1 second, 2 seconds, 3 seconds, 4 seconds, 5 seconds, and 6 seconds, respectively. In a similar manner, accelerometer measurements field 410 may store X standard deviations, where X≥1.

In some implementations, the time period may be based on balancing accuracy with time. For example, determining a standard deviation for accelerometer readings over a 10 second time period may provide a more accurate measurement of the standard deviation than when determining a standard deviation for accelerometer readings over a five second period of time, but requires more time.

As further shown in FIG. 4A, accelerometer measurements field 410 may store information identifying an average standard deviation (e.g., an average of a group of standard deviations, such as a group of five standard deviations, or a group of some other quantity of standard deviations). For example, accelerometer measurements field 410 may store information identifying a first average (e.g., Avg 1) of 19.43 mG, corresponding to an average of standard deviations 1 through 5 (e.g., an average of 11.22 mG, 10.33 mG, 22.02 mG, 24.49 mG, and 29.07 mG). Similarly, accelerometer measurements field 410 may store information identifying a second average (e.g., Avg 2) of 22.64 mG, corresponding to an average of standard deviations 2 through 6 (e.g., an average of 10.33 mG, 22.02 mG, 24.49 mG, 29.07 mG, and 27.28 mG). In a similar manner, accelerometer measurements field 410 may store Z averages, where Z≥1.

In some implementations, the quantity of standard deviations in the group may be based on balancing accuracy with time. For example, determining an average standard deviation for a group of 10 standard deviations may provide a more accurate measurement of the average standard deviation than when determining an average standard deviation for a group of five standard deviations, but requires more time.

As described in greater detail below with respect to FIG. 5, data collection device 220 may determine a key-on status of a vehicle when an average standard deviation exceeds a particular threshold. Further, data collection device 220 may determine a key-off status of the vehicle when a particular quantity of consecutive average standard deviations drops below the particular threshold (e.g., when 10 consecutive average standard deviations drop below the particular threshold). In some implementations, the quantity of consecutive average standard deviations may be based on balancing accuracy and time. For example, determining a key-off status when 10 consecutive average standard deviations drop below the particular threshold may be more accurate than determining a key off-status when 5 consecutive average standard deviations drop below the particular threshold, but requires more time. In some implementations, data collection device 220 may determine a key-on status of a vehicle based on some other technique, including or excluding the use of the average standard deviation. For example, data collection device 220 may determine a key-on status of a vehicle based on a running average of accelerometer measurements. Additionally, or alternatively, data collection device 220 may determine a key-on or key-off status when a variance of the accelerometer measurements satisfies a particular threshold, a distribution measurement of maximum and minimum values of the accelerometer measurements within a particular time period satisfies a particular threshold, an integral of a magnitude curve of the accelerometer measurements within a particular time period satisfies a particular threshold, and/or a quantity of axis interceptions of the magnitude curve of the accelerometer measurements satisfies a particular threshold. Additionally, or alternatively, data collection device 220 may determine a key-on or key-off status based on some other technique.

Referring to FIG. 4B, voltage measurements field 420 may store information identifying a time index and a corresponding voltage reading at the time index (e.g., corresponding to voltage measurement gathered by a voltage meter, associated with data collection device 220, and connected to a battery of a vehicle). As an example, assume that at time index=0 seconds, the voltage meter of data collection device 220 measures a voltage of 12.3 volts. Given this assumption, voltage measurements field 420 may associate a voltage reading of 12.3 volts with the time index of zero seconds. In a similar manner, voltage measurements field 420 may store voltage readings for T time indexes (where T≥0).

As further shown in FIG. 4B, voltage measurements field 420 may store information identifying a running average voltage reading over a particular time period (e.g., a running average over a five second time period, or some other time period). As an example, voltage measurements field 420 may store a first average (e.g., average 1) of 13.02 volts corresponding to the average voltage readings of 12.3 volts, 13.2 volts, 13.4 volts, 13.2 volts, 13.1 volts, and 12.9 volts at time indexes 0 seconds, 1 second, 2 seconds, 3 seconds, 4 seconds, and 5 seconds, respectively. In a similar manner, voltage measurements field 420 may store information identifying N running average voltage measurements (where N≥1).

As described in greater detail below with respect to FIG. 5, data collection device 220 may determine a key-on status of a vehicle when a running average voltage reading exceeds a particular threshold. Further, data collection device 220 may determine a key-off status of the vehicle when a particular quantity of consecutive running average voltage readings drop below the particular threshold (e.g., when 10 consecutive running average voltage readings drop below the particular threshold).

While particular fields are shown in a particular format in data structure 400, in practice, data structure 400 may include additional fields, fewer fields, different fields, or differently arranged fields than are shown in FIGS. 4A-4B. Also, FIGS. 4A-4B illustrate examples of information stored by data structure 400. In practice, other information may be stored by data structure 400.

Figure 5:
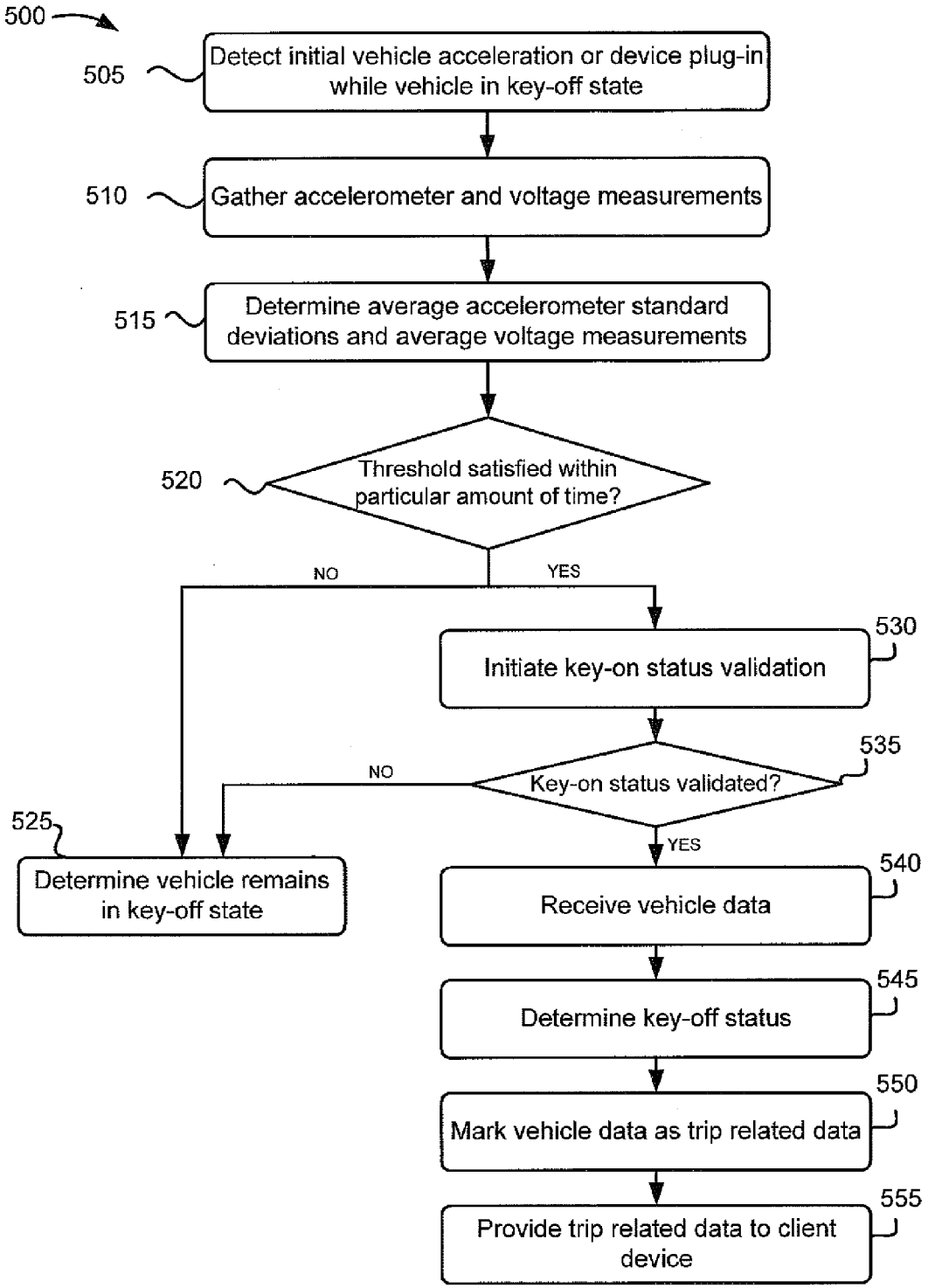
FIG. 5 illustrates a flowchart of an example process for determining a vehicle status.

FIG. 5 illustrates a flowchart of an example process 500 for determining a vehicle status. In one implementation, process 500 may be performed by one or more components of data collection device 220. In another implementation, some or all of blocks of process 500 may be performed by one or more components of another device in environment 200 (e.g., diagnostics system 210 and/or client server 230), or a group of devices including or excluding data collection device 220.

As shown in FIG. 5, process 500 may include detecting initial vehicle acceleration or device plug in while the vehicle is in a key-off state (block 505). For example, data collection device 220 may detect the initial vehicle acceleration (e.g., corresponding to an initial movement or vibration) when a circuit of an accelerometer of data collection device 220 trips when experiencing acceleration above a particular threshold (e.g., a threshold corresponding to vehicle movement or vibration). Additionally, or alternatively, data collection device 220 may detect the initial vehicle acceleration via a passive-mode accelerometer that may detect an acceleration that exceeds the particular threshold.

In some implementations, data collection device 220 may detect that data collection device 220 has been connected (e.g., plugged in) to diagnostics system 210 based on receiving a voltage when data collection device 220 connects to diagnostics system 210. In some implementations, the initial vehicle acceleration or the detection of the connection between data collection device 220 to diagnostics system 210 may indicate that the vehicle may have transitioned from a key-off state to a key-on state. In order to determine whether the vehicle has transitioned from the key-off state to the key-on state (or if the vehicle is still in the key-off state, indicating that the initial acceleration was not due to the vehicle being in operation), data collection device 220 may gather accelerometer and voltage measurements, as described below.

Process 500 may also include gathering accelerometer and voltage measurements (block 510). For example, data collection device 220 may gather accelerometer and voltage measurements based on detecting the initial vehicle acceleration or connection to diagnostics system 210. In some implementations, data collection device 220 may gather accelerometer and voltage measurements at time indexes corresponding to regular intervals (e.g., every one second, every two seconds, etc.). As described above, data collection device 220 may gather multiple accelerometer measurements per second and may determine an average of accelerometer readings at each time index. In some implementations, data collection device 220 may store accelerometer readings, corresponding to particular time indexes, in accelerometer measurements field 410. Further, data collection device 220 may store voltage readings, correspond to particular time indexes, in voltage measurements field 420.

Process 500 may further include determining average accelerometer standard deviations and average voltage measurements (block 515). For example, data collection device 220 may determine standard deviations of the accelerometer measurements (e.g., standard deviations of accelerometer measurements over a particular time period, such as a running five second time period or some other time period). Further, data collection device 220 may determine the averages of the standard deviations (e.g., averages of the last five standard deviations or average of some other quantity of standard deviations) as described above with respect to accelerometer measurements field 410. Further, data collection device 220 may determine the average voltage measurements (e.g., the average of the voltage measurements over a running five second time period or some other time period) as described above with respect to voltage measurements field 420. In some implementations, data collection device 220 may continue to determine average accelerometer standard deviations and average voltage measurements (e.g., over a running time period) for a particular amount of time (e.g., for one minute, two minutes, or some other amount of time).

Process 500 may also include determining whether a threshold is satisfied within a particular amount of time (block 520). For example, data collection device 220 may determine whether an average accelerometer standard deviation satisfies (e.g., exceeds) a first threshold (e.g., a threshold that indicates that the vehicle is in motion and/or that an engine of the vehicle is in operation) within the particular amount of time. In some implementations, the first threshold may range from 10 mG to 30 mG and may be approximately 20 mG. In some implementations, the first threshold may be in some other range or value.

In some implementations, data collection device 220 may determine whether an average voltage satisfies (e.g., exceeds) a second threshold (e.g., a threshold that indicates that an engine of the vehicle is in operation) within the particular amount of time. In some implementations, the second threshold may be in the range from 12 volts to 14 volts, and may be approximately 13 volts. In some implementations, the second threshold may be in some other range or value.

In some implementations, the particular amount of time may be selected to balance accuracy and time. For example, a relatively longer amount of time may allow data collection device 220 to determine additional average accelerometer standard deviations and average voltage measurements and to increase the sample size used to determine whether a threshold has been satisfied. In some implementations, the amount of time may be user configurable.

If, for example, the first threshold or the second threshold is not satisfied within the particular amount of time (block 520—NO), process 500 may include determining that the vehicle remains in the key-off state (block 525). For example, data collection device 220 may determine that the vehicle remains in the key-off state when the first threshold or the second threshold is not satisfied within the particular amount of time. In some implementations, determining that the vehicle remains in the key-off state may indicate that the detection of the initial vehicle acceleration (as described above with respect to process block 505), does not correspond to a key-on state where the vehicle is in operation. For example, the detection of the initial vehicle acceleration may correspond to when a force has been applied to the vehicle, such as when a pedestrian or other object applies a force when contacting the vehicle (e.g., when navigating around the vehicle in a parking space, etc.), when the door of another vehicle is slammed closed, when a jet airplane takes off at a nearby airport, or when some other force is applied to the vehicle to cause the accelerometer device to detect the initial vehicle acceleration. In some implementations, data collection device 220 may prevent, or at least decline to initiate, particular communications with diagnostics system 210 based on determining that the vehicle remains in the key-off state. For example, data collection device 220 may not initiate key-on communications with diagnostics system 210 that may cause operational interferences when the vehicle is in the key-off state, or that would needlessly drain the vehicle's battery, but may permit key-off communications with diagnostics system 210 that may not cause operational interferences when the vehicle is in the key-off state.

If, on the other hand, the first threshold or the second threshold is satisfied within the particular amount of time (block 520—YES), process 500 may further include initiating a key-on status validation (block 530). For example, data collection device 220 may determine that the vehicle is in a key-on state and may communicate with diagnostics system 210 to validate (e.g., confirm) the key-on status for the vehicle. Additionally, or alternatively, data collection device 220 may communicate with diagnostics system 210 to validate the key-on status based on determining (e.g., based on the average voltage) that the battery of the vehicle is being charged (e.g., when the average voltage continuously drops and rises, indicating that the battery of the vehicle is being charged and that the engine is running). In some implementations, data collection device 220 may initiate a limited key-on communication (e.g., via a key-on communications channel) with diagnostics system 210 to determine the vehicle's engine speed (e.g., in revolutions per minute (RPM), or some other unit of engine speed measurement). For example, diagnostics system 210 may provide information identifying the vehicle's engine speed when data collection device 220 initiates the communication with diagnostics system 210.

Process 500 may also include determining whether the key-on status has been validated (block 535). For example, data collection device 220 may determine that the key-on status has been validated when the vehicle's engine speed exceeds a particular threshold, such as zero (thereby indicating that the vehicle's engine is running). In some implementations, data collection device 220 may fail to validate the key-on status when the vehicle's engine speed does not exceed the particular threshold (thereby indicating the vehicle's engine is not running).

If, for example, data collection device 220 fails to validate the key-on status (block 535—NO), process 500 may further include determining that the vehicle remains in the key off state as described above with respect to process block 525. Further data collection device 220 may discontinue the limited key-on communication (e.g., the communication used to determine the vehicle's engine speed) and prevent key-on communications with diagnostics system 210 to prevent the vehicle's battery from draining and/or to prevent other vehicle operational interferences.

If, for example, data collection device 220 validates the key-on status (block 540—YES), process 500 may also include receiving vehicle data (block 540). For example, data collection device 220 may receive vehicle data (e.g., key-on vehicle data) from diagnostics system 210 via the communication initiated by data collection device 220 to diagnostics system 210 as described above with respect to process block 530 (e.g., via a key-on communications channel). Further, data collection device 220 may determine that a vehicle trip has started based on validating the key-on status and that the vehicle data gathered, after validating the key-on status, is related to a vehicle trip. In some implementations, data collection device 220 may receive and store vehicle data, such as vehicle velocity, engine speed, gasoline consumption, throttle, and/or some other vehicle data that diagnostics system 210 may provide (e.g., data in accordance with an OBD protocol, an OBD II protocol, or the like).

Process 500 may further include determining a key-off status (block 545). For example, data collection device 220 may determine a key off status when diagnostics system 210 provides vehicle data that identifies that the vehicle's engine speed is zero. In some implementations (e.g., when diagnostics system 210 does not provide vehicle data that identifies that the vehicle's engine speed is zero), data collection device 220 may determine the key-off status when average standard deviations and/or average voltage measurements, over a particular period of time, do not satisfy respective thresholds (e.g., indicating that the vehicle has stopped moving and/or that the engine has powered off when the battery's average voltage has dropped below a threshold). In some implementations, the particular period of time may be selected to compensate for when the vehicle's engine is running, but the vehicle is not in motion (e.g., when the vehicle is stopped at a traffic light, etc.). Additionally, or alternatively, the particular period of time may be selected to compensate for when the engine has not been running for the particular period of time, but when the trip has not completed (e.g., in a hybrid vehicle where the engine may temporarily shut-off during a trip). Examples of determining average standard deviations and average voltage measurements are described above with respect to data structure 400 and process block 515.

Process 500 may also include marking the vehicle data as trip related data (block 550). For example, data collection device 220 may mark the vehicle data, received between the time the key-on status was validated and the time at which a key-off status was determined, as trip related data. In some implementations, data collection device 220 may generate a file and store the trip related data in the file. In some implementations, the trip related data may include vehicle data for a vehicle trip that corresponds to a time period between when the vehicle transitioned from a key-on status to a key-off status. In some implementations, data collection device 220 may generate multiple files including multiple sets of trip related data corresponding to multiple vehicle trips or multiple files corresponding to one trip.

Process 500 may further include providing the trip related data to a client server (block 555). For example, data collection device 220 may provide the trip related data to client server 230 based on determining the key-off status and generating the file including the trip related data. In some implementations, data collection device 220 may provide the trip related data to client server 230 without user interaction. Additionally, or alternatively, data collection device 220 may provide the trip related data based on receiving a request from client server 230 for the trip related data. For example, client server 230 may request one or more files, generated by data collection device 220, that include trip related data. In some implementations, client server 230 may process the trip related data to aid in analysis, such as a vehicle troubleshooting analysis, a vehicle usage analysis, insurance rating analysis, etc.

While FIG. 5 shows process 500 as including a particular quantity and arrangement of blocks, in some implementations, process 500 may include fewer blocks, additional blocks, or a different arrangement of blocks. Additionally, or alternatively, some of the blocks may be performed in parallel. Also, data collection device 220 may determine a key-on or key-off status based on some other technique, in addition to, or in alternative of, average of standard deviations of accelerometer measurements and average voltage measurements. For example, data collection device 220 may determine a key-on or key-off status when a variance of the accelerometer measurements satisfies a particular threshold, a distribution measurement of maximum and minimum values of the accelerometer measurements within a particular time period satisfies a particular threshold, an integral of a magnitude curve of the accelerometer measurements within a particular time period satisfies a particular threshold, and/or a quantity of axis interceptions of the magnitude curve of the accelerometer measurements satisfies a particular threshold. Additionally, or alternatively, data collection device 220 may determine a key-on or key-off status based on some other technique.

Figure 6A:
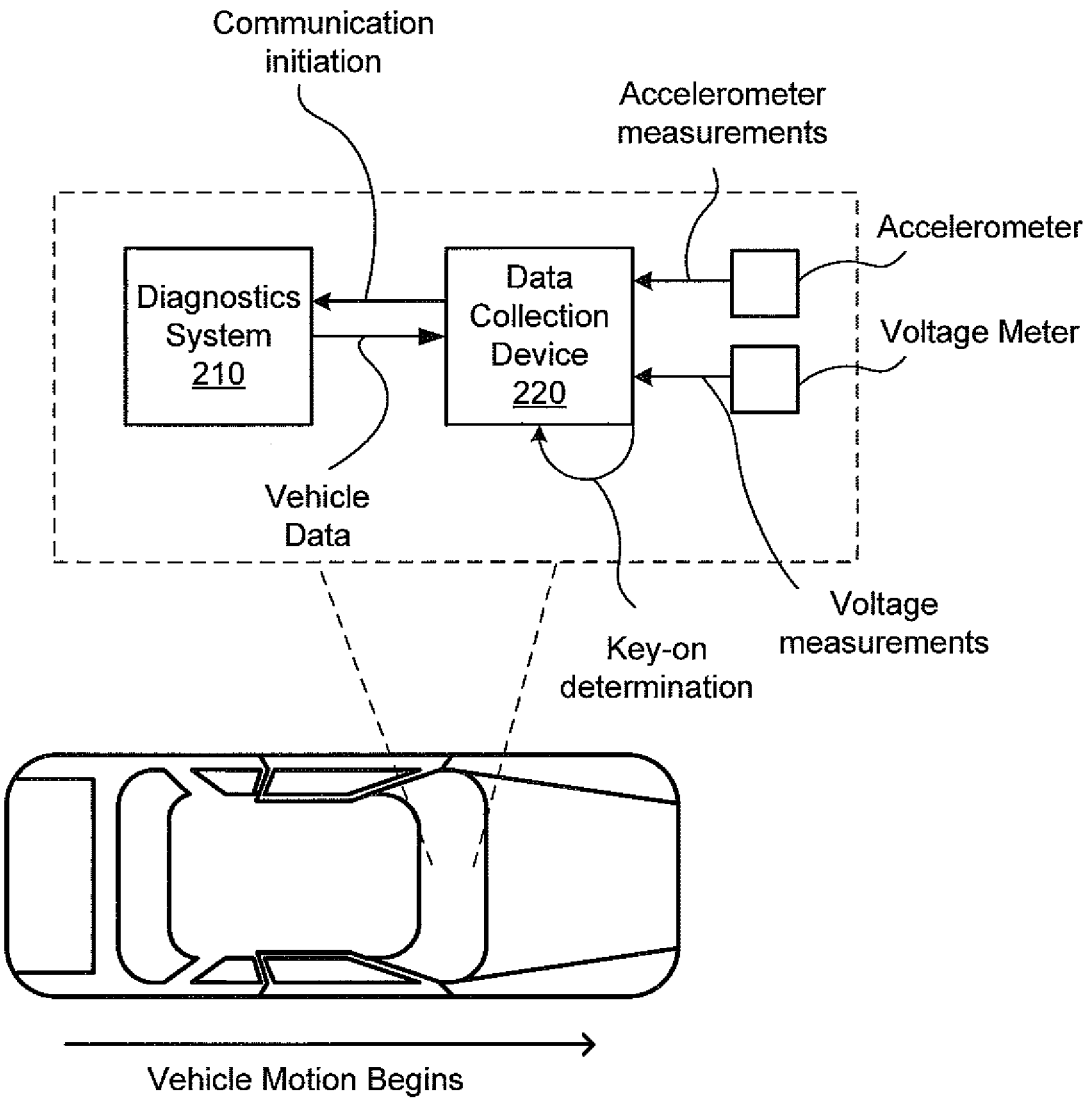
FIGS. 6A-6B illustrate an example implementation as described herein.
Figure 6B:
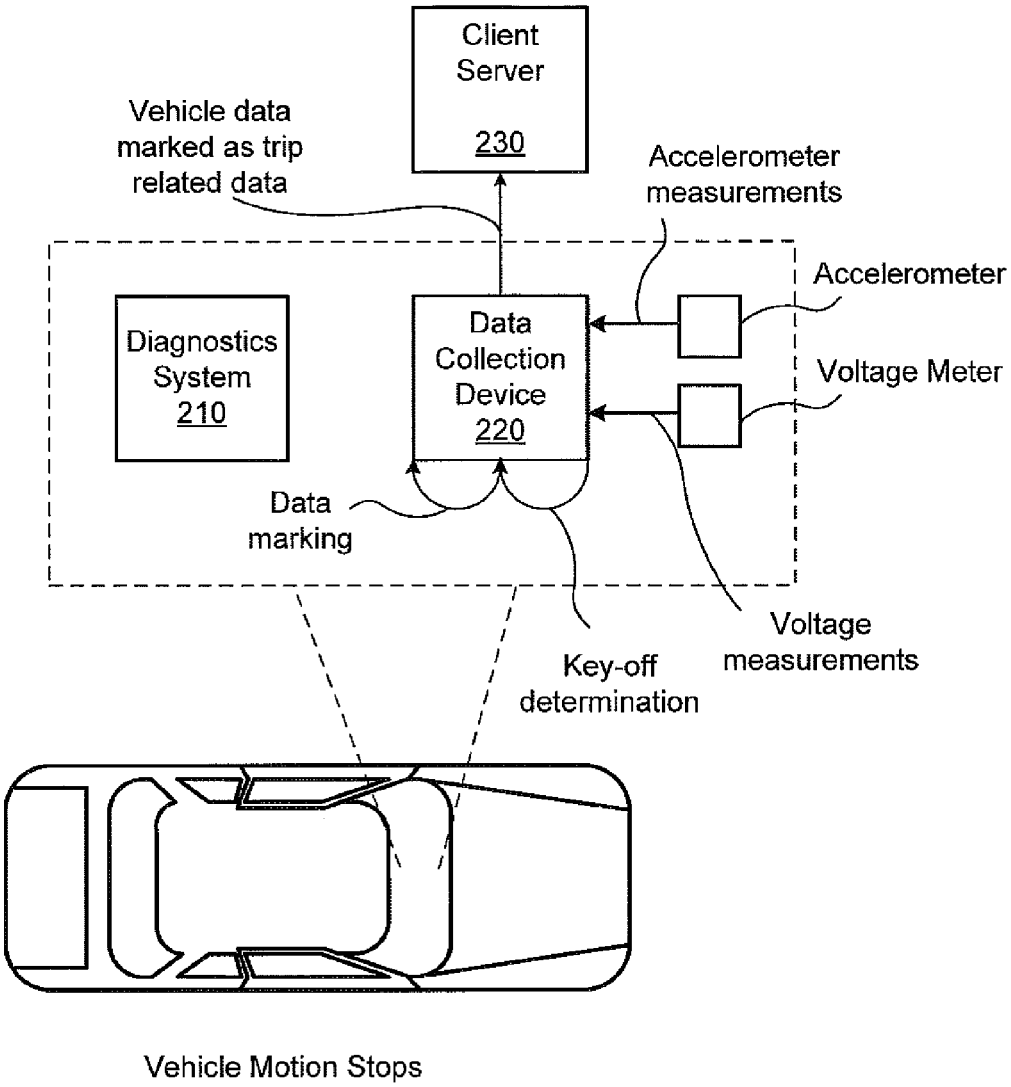

FIGS. 6A-6B illustrate an example implementation as described herein. In FIG. 6A, assume that a vehicle is currently in a key-off state. As shown in FIG. 6A, data collection device 220 may begin to gather accelerometer measurements and voltage measurements (e.g., from an accelerometer and a voltage meter associated with data collection device 220) based on detecting an initial acceleration of the vehicle when the vehicle goes in motion (e.g., via a passive-mode accelerometer or when the initial acceleration causes a circuit to trip). In some implementations, data collection device 220 may determine that the vehicle may have transitioned from the key-off to the key-on state when an average accelerometer standard deviation and/or an average voltage exceed respective thresholds within a particular amount of time (e.g., as described above with respect to process block 520).

In FIG. 6A, assume that an average accelerometer standard deviation and/or an average voltage exceed a respective threshold. Given this assumption, data collection device 220 may determine that the vehicle has potentially transitioned from the key-off to the key-on state and may communicate with diagnostics system 210 to validate that the vehicle has transitioned from the key-off to the key-on state. For example, data collection device 220 may initiate a communication with diagnostics system 210 and may receive vehicle data based on the communication. In some implementations, data collection device 220 may determine the vehicle's engine speed based on the vehicle data and may validate that the vehicle has transitioned from the key-off to the key-on state when the vehicle's engine speed exceeds a threshold (e.g., a threshold of zero). Based on validating that the vehicle has transitioned from the key-off to the key-on state when the vehicle's engine speed exceeds a threshold, data collection device 220 may continue to receive the vehicle data. As described above, data collection device 220 may disconnect with diagnostics system 210 if validation of the key-on state fails (e.g., when vehicle's engine speed is zero).

Referring to FIG. 6B, assume that the vehicle's motion has stopped and that the vehicle's engine has powered off. Given these assumptions, data collection device 220 may determine that the vehicle has transitioned from the key-on to the key-off state (e.g., when the vehicle data indicates that the engine speed is zero). Additionally, or alternatively, data collection device 220 may determine that the vehicle has transitioned from the key-on to the key-off state when average accelerometer standard deviations and/or an average voltage measurements do not exceed respective thresholds within a particular amount of time (e.g., as described above with respect to process block 545). As further shown in FIG. 6B, data collection device 220 may mark the vehicle data as trip related data (e.g., vehicle data related to a vehicle trip corresponding to period between when the vehicle transitioned from a key-on state to a key-off state). Further, data collection device 220 may provide the trip related data to client server 230.

While a particular example is shown in FIGS. 6A-6B, the above description is merely an example implementation. In practice, other examples are possible from what is described above in FIGS. 6A-6B.

As described above, data collection device 220 may determine a key-on or key-off state for a vehicle without communicating with diagnostics system 210, thereby preventing data collection device 220 from communicating with diagnostic system 210 (e.g., via a key-on channel) when the vehicle is in the key-off state, and thus preventing the vehicle's systems from behaving erratically.

In some implementations, data collection device 220 may communicate with diagnostics system 210 (e.g., via a key-on channel) to receive vehicle data (e.g., information identifying the vehicle's velocity, engine speed, throttle, gasoline consumption, etc.) based on determining that the vehicle is in a key-on state. In some implementations, data collection device 220 may identify when a vehicle trip starts and ends (e.g., corresponding to when the vehicle is in the key-on and key-off states), and may collect trip related data (e.g., vehicle data that is gathered during a period between when the vehicle is in the key-on and key-off states). In some implementations, data collection device 210 may provide the trip related data to client server 230.

The foregoing description provides illustration and description, but is not intended to be exhaustive or to limit the possible implementations to the precise form disclosed. Modifications and variations are possible in light of the above disclosure or may be acquired from practice of the implementations.

It will be apparent that different examples of the description provided above may be implemented in many different forms of software, firmware, and hardware in the implementations illustrated in the figures. The actual software code or specialized control hardware used to implement these examples is not limiting of the implementations. Thus, the operation and behavior of these examples were described without reference to the specific software code—it being understood that software and control hardware can be designed to implement these examples based on the description herein.

Even though particular combinations of features are recited in the claims and/or disclosed in the specification, these combinations are not intended to limit the disclosure of the possible implementations. In fact, many of these features may be combined in ways not specifically recited in the claims and/or disclosed in the specification. Although each dependent claim listed below may directly depend on only one other claim, the disclosure of the possible implementations includes each dependent claim in combination with every other claim in the claim set.

No element, act, or instruction used in the present application should be construed as critical or essential unless explicitly described as such. Also, as used herein, the article "a" is intended to include one or more items and may be used interchangeably with "one or more." Where only one item is intended, the term "one" or similar language is used. Further, the phrase "based on" is intended to mean "based, at least in part, on" unless explicitly stated otherwise.

Some implementations are described herein in conjunction with thresholds. The term "greater than" (or similar terms), as used herein to describe a relationship of a value to a threshold, may be used interchangeably with the term "greater than or equal to" (or similar terms). Similarly, the term "less than" (or similar terms), as used herein to describe a relationship of a value to a threshold, may be used interchangeably with the term "less than or equal to" (or similar terms). As used herein, "satisfying" a threshold (or similar terms) may be used interchangeably with "being greater than a threshold," "being greater than or equal to a threshold," "being less than a threshold," "being less than or equal to a threshold," or other similar terms, depending on the context in which the threshold is used.

To the extent the aforementioned implementations collect, store, or employ personal information provided by individuals, it should be understood that such information shall be used in accordance with all applicable laws concerning protection of personal information. Additionally, the collection, storage, and use of such information may be subject to consent of the individual to such activity, for example, through "opt-in" or "opt-out" processes as may be appropriate for the situation and type of information. Storage and use of personal information may be in an appropriately secure manner reflective of the type of information, for example, through various encryption and anonymization techniques for particularly sensitive information.

What is claimed is:

1. A method comprising:

receiving, by a device, accelerometer measurements associated with a vehicle;

receiving, by the device, voltage measurements associated with a power source connected to the vehicle;

determining, by the device, a key-on status or a key-off status of the vehicle based on the accelerometer measurements or the voltage measurements without communicating with a vehicle diagnostic system associated with the vehicle, the key-off status corresponding to an engine of the vehicle being powered off, and the key-on status corresponding to the engine of the vehicle being powered on;

initiating, by the device, communications with the vehicle diagnostic system to obtain first vehicle data based on determining the key-on status;

receiving the first vehicle data based on initiating the communications with the vehicle diagnostic system;

validating the key-on status if the first vehicle data received from the vehicle diagnostic system indicates the engine of the vehicle is powered on; and receiving second vehicle data, different than the first vehicle data, from the vehicle diagnostic system based on validating the key-on status.

2. The method of claim 1, further comprising:

determining an average standard deviation of the accelerometer measurements; and determining an average of the voltage measurements, wherein determining the key-off status of the vehicle includes determining that the average standard deviation does not satisfy a first threshold or that the average of the voltage measurements does not satisfy a second threshold.

3. The method of claim 1, further comprising:

determining an average standard deviation of the accelerometer measurements; and determining average of the voltage measurements, wherein determining the key-on status of the vehicle includes determining that the average standard deviation satisfies a first threshold or that the average of the voltage measurements satisfies a second threshold.

4. The method of claim 1, wherein the device is a first device, the method further comprising:

determining the key-off status after determining the key-on status and receiving the second vehicle data;

marking the second vehicle data as trip data corresponding to data received during a period between when the key-on status is determined and when the key-off status is determined; and providing the second vehicle data to a second device.

5. The method of claim 1, further comprising:

detecting an initial acceleration of the vehicle, wherein receiving the accelerometer measurements and the voltage measurements are based on detecting the initial acceleration of the vehicle.

6. The method of claim 1, further comprising:

detecting an initial connection to the vehicle diagnostics system, wherein receiving the accelerometer measurements and the voltage measurements are based on detecting the initial connection to the vehicle diagnostics system.

7. The method of claim 1, further comprising:

preventing communications with the vehicle diagnostic system over a particular channel based on determining the key-off status.

8. The method of claim 1, further comprising:

invalidating the key-on status if the first vehicle data received from the vehicle diagnostic system indicates the engine of the vehicle is powered off; and ending the communications with the vehicle diagnostic system based on invalidating the key-on status.

9. The method of claim 1, where the first vehicle data indicates an engine speed of the engine, and validating the key-on status includes validating the key-on status if the engine speed is greater than zero.

10. The method of claim 9, further comprising:

invalidating the key-on status if the engine speed is not greater than zero; and ending the communications with the vehicle diagnostic system based on invalidating the key-on status.

11. The method of claim 1, where the first vehicle data indicates a voltage of a battery included in the vehicle, and validating the key-on status includes validating the key-on status if the voltage indicates the battery is being charged.

12. The method of claim 11, further comprising:

invalidating the key-on status if the voltage indicates the battery is not being charged; and ending the communications with the vehicle diagnostic system based on invalidating the key-on status.

13. A device comprising:

one or more processors to:

receive accelerometer measurements associated with a vehicle;

receive voltage measurements associated with a power source connected to the vehicle;

determine a key-on status or a key-off status of the vehicle based on the accelerometer measurements or the voltage measurements without communicating with a vehicle diagnostic system associated with the vehicle, the key-off status corresponding to an engine of the vehicle being powered off, and the key-on status corresponding to the engine of the vehicle being powered on;

initiate communications with the vehicle diagnostic system to obtain first vehicle information based on determining the key-on status;

receive the first vehicle information based on initiating the communications with the vehicle diagnostic system;

validate the key-on status if the first vehicle information received from the vehicle diagnostic system indicates the engine of the vehicle is powered on; and receive second vehicle information, different than the first vehicle information, from the vehicle diagnostic system based on validating the key-on status.

14. The device of claim 13, where the one or more processors are further to:

prohibit communications with the vehicle diagnostic system over a key-on channel based on determining the key-off status.

15. The device of claim 13, where the one or more processors, when initiating communications with the vehicle diagnostic system to obtain the first vehicle information, are to:

communicate with the vehicle diagnostic system via a serial connection port included in the vehicle.

16. The device of claim 13, further comprising:

an accelerometer to detect the accelerometer measurements; and a voltage meter to detect the voltage measurements, the accelerometer and the voltage meter being separate from the vehicle diagnostic system.

17. The device of claim 13, where the one or more processors are further to:

invalidate the key-on status when the first vehicle information received from the vehicle diagnostic system indicates the engine of the vehicle is powered off and the accelerometer measurement indicates an acceleration greater than a threshold value.

18. A non-transitory computer-readable medium for storing instructions, the instructions comprising:

a plurality of instructions which, when executed by one or more processors associated with a device, cause the one or more processors to:

receive accelerometer measurements associated with a vehicle;

receive voltage measurements associated with a power source connected to the vehicle;

determine a key-on status or a key-off status of the vehicle based on the accelerometer measurements or the voltage measurements independent of communicating with a vehicle diagnostic system associated with the vehicle, the key-off status corresponding to an engine of the vehicle being powered off, and the key-on status corresponding to the engine of the vehicle being powered on;

initiate communications with the vehicle diagnostic system to obtain first vehicle information based on determining the key-on status;

receive the first vehicle information based on initiating the communications with the vehicle diagnostic system;

validate the key-on status if the first vehicle information received from the vehicle diagnostic system indicates the engine of the vehicle is powered on; and receive second vehicle information, different than the first vehicle information, from the vehicle diagnostic system based on validating the key-on status.

* * * * *